US006767225B1

(12) United States Patent
Hwang

(10) Patent No.: US 6,767,225 B1
(45) Date of Patent: Jul. 27, 2004

(54) STRUCTURE OF CONNECTOR

(76) Inventor: Chin-Hwa Hwang, No. 14, Alley 6, Lane 315, Chung Cheng N. Rd., Sanchung, Taipei 241 (TW)

( * ) Notice: Subject to any disclaimer, the term of this patent is extended or adjusted under 35 U.S.C. 154(b) by 0 days.

(21) Appl. No.: 10/625,561

(22) Filed: Jul. 24, 2003

(51) Int. Cl.[7] ..... H01R 12/00
(52) U.S. Cl. ..... 439/79
(58) Field of Search ..... 439/564, 79, 607, 439/712, 567

(56) References Cited

U.S. PATENT DOCUMENTS 5,865,645 A * 2/1999 Embo et al. ..... 439/567
5,879,171 A * 3/1999 Wu ..... 439/79
5,947,769 A * 9/1999 Leonard et al. ..... 439/607
5,957,705 A * 9/1999 David et al. ..... 439/79
5,989,041 A * 11/1999 Lin ..... 439/79
6,017,223 A * 1/2000 Lai ..... 439/79
6,022,227 A * 2/2000 Huang ..... 439/79
6,066,002 A * 5/2000 Sterckx et al. ..... 439/607
6,077,115 A * 6/2000 Yang et al. ..... 439/567
6,095,853 A * 8/2000 Huang et al. ..... 439/541.5
6,099,327 A * 8/2000 Chen ..... 439/95
6,171,134 B1 * 1/2001 Lai ..... 439/405
6,206,730 B1 * 3/2001 Avery et al. ..... 439/609
6,210,219 B1 * 4/2001 Zhu et al. ..... 439/567
6,287,146 B1 * 9/2001 Avery et al. ..... 439/607
6,379,181 B1 * 4/2002 Chang et al. ..... 439/567
6,447,307 B1 * 9/2002 Wu ..... 439/79
6,468,108 B1 * 10/2002 Wu ..... 439/567
6,527,564 B1 * 3/2003 Yeh ..... 439/76.1
6,537,086 B1 * 3/2003 Mac Mullin ..... 439/79
6,554,642 B1 * 4/2003 Xiang et al. ..... 439/567
6,619,968 B2 * 9/2003 Xu ..... 439/79
6,626,700 B2 * 9/2003 Lin ..... 439/541.5
6,709,286 B1 * 3/2004 Korsunsky et al. ..... 439/557

* cited by examiner

*Primary Examiner*—Ross Gushi
(74) *Attorney, Agent, or Firm*—Bacon & Thomas, PLLC

(57) ABSTRACT

The improved structure of connector is fast and sure in fixing and positioning and at least comprises an insertion-connecting socket unit, a lower lid, a metallic housing for an insertion slot, a group of pins and a plurality of metallic covers; it is characterized by: the insertion-connecting socket unit has on two lateral sides thereof protruding engaging posts having therebeneath recesses, the lower lid has at the two lateral sides thereof columns having on their inner sides engaging grooves in corresponding in position to the protruding engaging posts, the engaging grooves have protruding engaging blocks in corresponding in position to the recesses, thereby, the insertion-connecting socket unit and the lower lid can get their effects of positioning and fixing by fixed engagement of the protruding engaging posts with the engaging grooves as well as the recesses with the protruding engaging blocks.

5 Claims, 4 Drawing Sheets

STRUCTURE OF CONNECTOR

BACKGROUND OF THE INVENTION

1. Field of the Invention

The present invention is related to an improved structure of connector, and especially to such a connector structure capable of fast and sure in fixing and positioning.

2. Description of the Prior Art

Generally, such a connector is used to insertion connect connecting devices (for example, hard disks etc. are insertion-connecting devices). Such a connector is provided on an electronic device, and is provided therein with a group of pins to connect with electric lines, in order that insertion connecting of a connecting device can make the electronic device read the memory data stored in some portable connecting devices, thereby a connecting device with good connecting effect can substantially influence the effect of reading of the connecting device.

A conventional connecting device is composed of an insertion-connecting socket unit and a base, locking holes are provided on the insertion-connecting socket unit and the base, so that locking elements can be extended through the locking holes to lock the connecting device onto an electronic device, and the inner pin group of the connecting device and the electric lines of the electronic device can be connected mutually, hence when the connecting device performs the operations of insertion and extraction on a connector, the insertion-connecting socket unit and the base are subjected to loosening, and even to inefficient reading.

SUMMARY OF THE INVENTION

Accordingly, in view of the above stated long existing defects including inferior effect of positioning and being subjected to loosening to affect the effect of reading, the inventor of the present invention developed the improved structure of connector to get rid of the defects resided in the conventional connecting devices based on his professional experience of years in studying, designing and manufacturing same kind of products and after hard study as well as repeated experiments and tests.

Therefore, the improved structure of connector of the present invention at least comprises an insertion-connecting socket unit, a lower lid, a metallic housing for an insertion slot, a group of pins and a plurality of metallic covers; it is characterized by that: the insertion-connecting socket unit has on the two lateral sides thereof protruding engaging posts which have therebeneath recesses, the lower lid has at the two lateral sides thereof columns which are provided on their inner sides with engaging grooves in corresponding in position to the protruding engaging posts, the engaging grooves are provided with protruding engaging blocks in corresponding in position to the recesses, thereby, the insertion-connecting socket unit and the lower lid can get their effects of positioning and fixing by fixed engagement of the protruding engaging posts with the engaging grooves as well as the recesses with the protruding engaging blocks.

The object of the present invention is to get the effects of positioning and fixing of the insertion-connecting socket unit and the lower lid by fixed engagement of the protruding engaging posts with the engaging grooves as well as the recesses with the protruding engaging blocks provided on the two lateral sides respectively of the insertion-connecting socket unit and the lower lid.

Another object of the present invention is to provide on mutually corresponding positions of the insertion-connecting socket unit to the metallic housing for an insertion slot respectively with insertion dents and engaging strip portions, in order that the metallic housing can be fixed on the insertion-connecting socket unit by insertion connecting of the insertion dents with the engaging strip portions.

Another object of the present invention is to provide insertion dents and engaging strip portions respectively on positions for connection of the columns at the two lateral sides of the lower lid to the metallic covers, in order that the metallic covers can be fixed on the columns of the lower lid by insertion connecting of the insertion dents and the engaging strip portions.

A further object of the present invention is to provide round holes of which the centers are to be aligned mutually respectively on the columns at the two lateral sides of the lower lid and on the metallic housing for the insertion slot, in order that locking elements can extend through the mutually aligned round holes to lock them on an electric circuit board.

The present invention will be apparent in its contents and effects after reading the detailed description of the preferred embodiment thereof in reference to the accompanying drawings.

DETAILED DESCRIPTION OF THE PREFERRED EMBODIMENT

Figure 1:
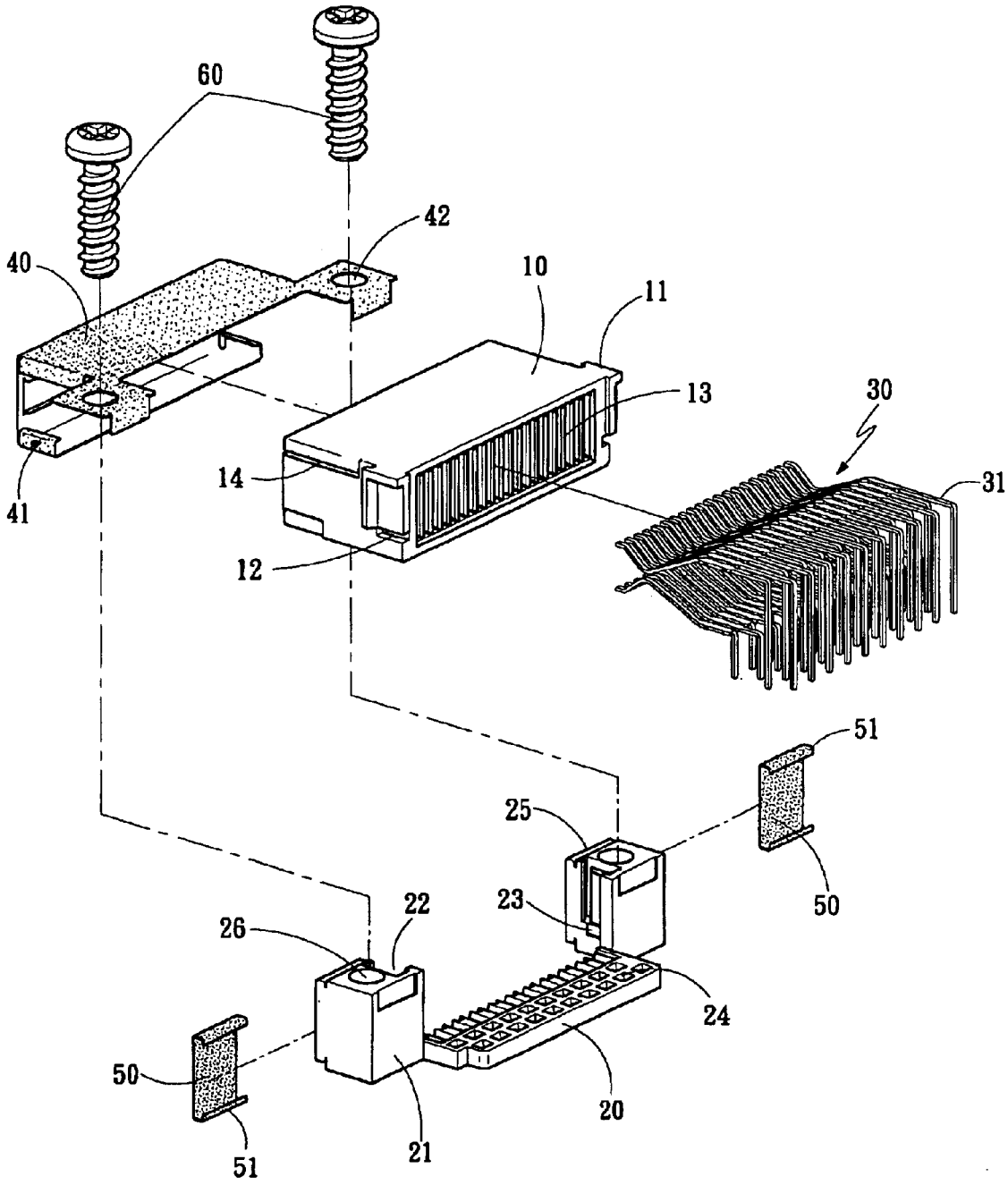
FIG. 1 is an analytic perspective view of the present invention.
Figure 2:
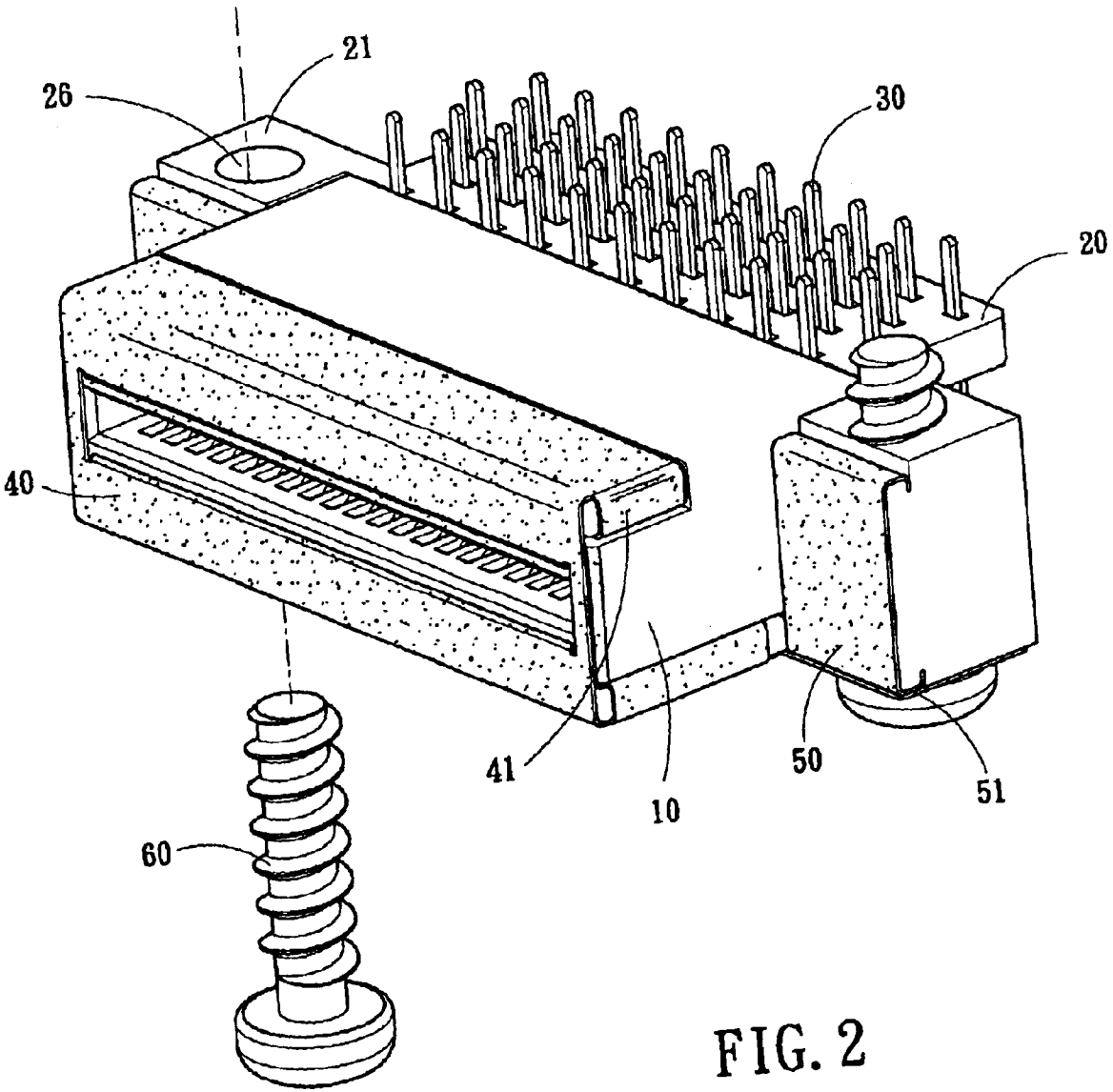
FIG. 2 is a schematic perspective view showing the backside of the present invention.

Referring to FIGS. 1 and 2, the improved structure of connector of the present invention at least comprises an insertion-connecting socket unit 10, a lower lid 20, a group of pins 30, a metallic housing 40 for an insertion slot, and a plurality of metallic covers 50, wherein:

The insertion-connecting socket unit 10 has on the two lateral sides thereof protruding engaging posts 11 which have therebeneath recesses 12; a group of pin jacks 13 are provided on the end of the insertion-connecting socket unit 10 for connecting with the group of pins 30, the insertion-connecting socket unit 10 is provided on the upper and the lower areas on the two lateral sides thereof in opposition to the metallic housing 40 with insertion dents 14.

The lower lid 20 has at the two lateral sides thereof columns 21 which are provided on their inner sides with engaging grooves 22 and protruding engaging blocks 23 to be in corresponding in position respectively to the protruding engaging posts 11 and the recesses 12 of the insertion-connecting socket unit 10; and the lower lid 20 has in corresponding to the group of pins 30 a group of pin holes 24, the columns 21 each has on the upper and lower ends thereof insertion dents 25.

The group of pins 30 are composed of a lot of pins 31 in corresponding to the group of pin jacks 13 of the insertion-connecting socket unit 10 and to the group of pin holes 24 of the lower lid 20.

The metallic housing 40 for an insertion slot is provided on the outside of the insertion-connecting socket unit 10, and is provided thereon in corresponding in position to the insertion dents 14 of the insertion-connecting socket unit 10 with engaging strip portions 41.

The metallic covers 50 are provided on the columns 21 of the lower lid 20, and are provided thereon in corresponding in position to the insertion dents 25 of the columns 21 with engaging strip portions 51.

When in assembling, the group of pins 30 are respectively inserted into the group of pin jacks 13 of the insertion-connecting socket unit 10 and the group of pin holes 24 of the lower lid 20; and after positioning of the group of pins 30, the engaging grooves 22 of the lower lid 20 are in corresponding in position to the protruding engaging posts 11 of the insertion-connecting socket unit 10, thereby the insertion-connecting socket unit 10 can be insertion connected to the lower lid 20, and the recesses 12 on the insertion-connecting socket unit 10 can be engaged exactly with the protruding engaging blocks 23 of the lower lid 20. Thereby, the insertion-connecting socket unit 10 and the lower lid 20 can be connected to each other, and the effects of positioning and fixing can be achieved.

Then the metallic housing 40 is engaged with the insertion dents 14 on the two lateral sides of the insertion-connecting socket unit 10 by means of the engaging strip portions 41, so that the metallic housing 40 can be fixedly engaged with the insertion-connecting socket unit 10; and the metallic covers 50 are fixed on the columns 21 at the two lateral sides of the lower lid 20 by insertion connecting of the engaging strip portions 51 with the insertion dents 25.

The metallic housing 40 and the columns 21 at the two lateral sides of the lower lid 20 are provided with first round holes 42 and second round holes 26 respectively of which the centers are to be aligned mutually, the first round holes 42 and the second round holes 26 are locked with locking elements 60.

Figure 3:
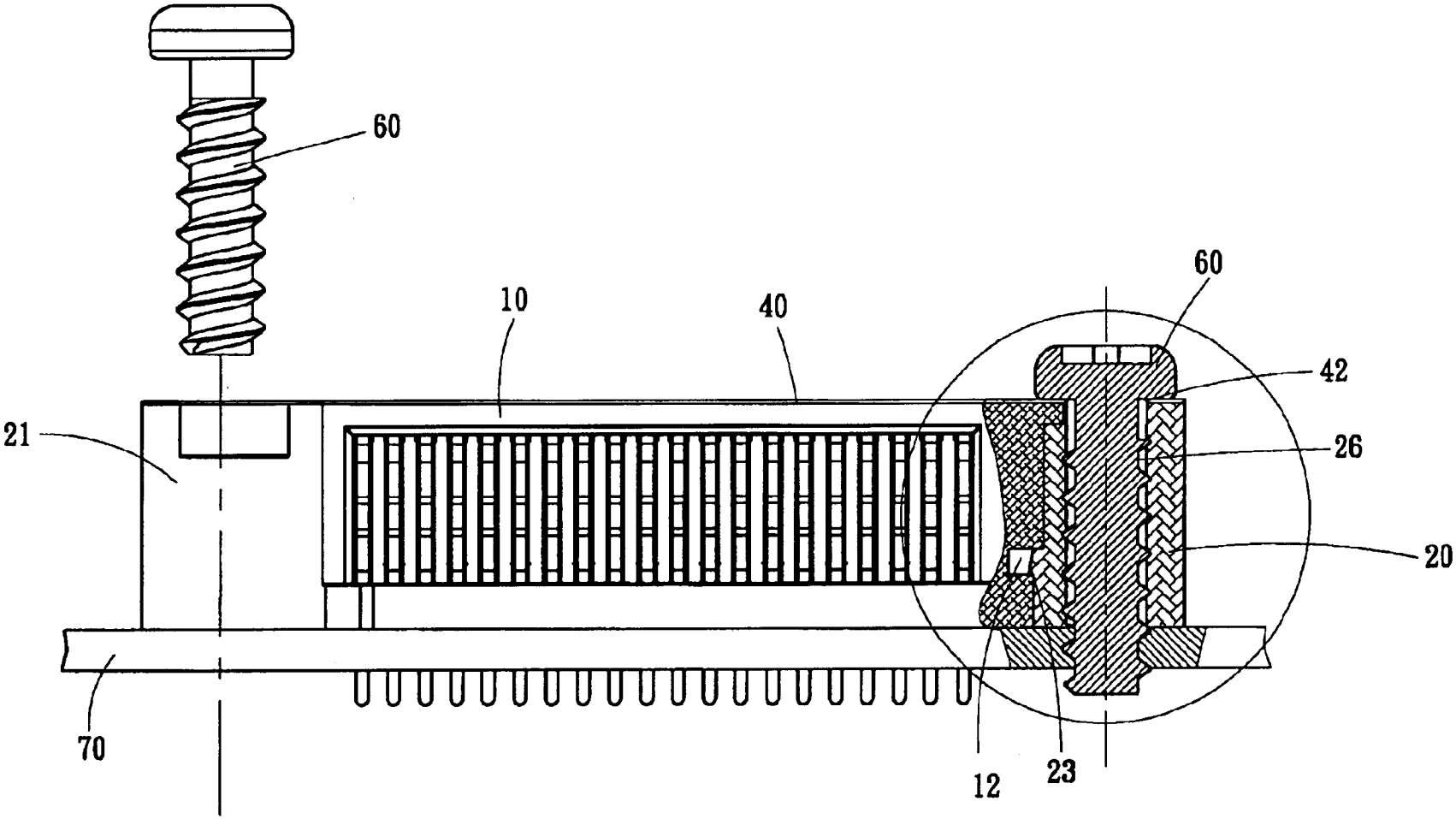
FIG. 3 is a schematic sectional view of the present invention.
Figure 4:
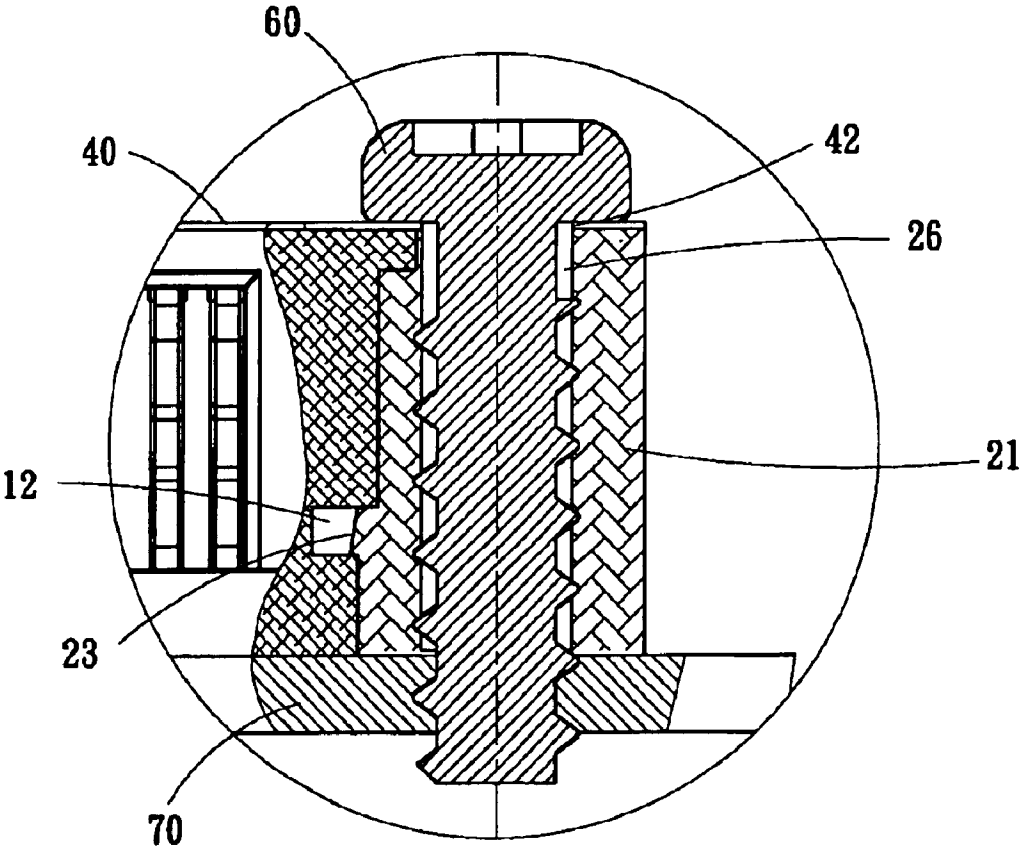
FIG. 4 is a schematic sectional view showing a part of the present invention.

Referring to simultaneously to FIGS. 3 and 4, when the connector is fixed on an electric circuit board 70, it uses mainly the first round holes 42 and the second round holes 26 formed on the columns 21 at the two lateral sides of the lower lid 20 and the metallic housing 40 respectively, and uses the locking elements 60 to extend through the first round holes 42 and the second round holes 26 to lock itself on the electric circuit board 70. In this mode, not only the effects of positioning and fixing of the connector can be achieved, but also the insertion-connecting socket unit 10 and the lower lid 20 can be connected with each other by fixed engagement of the recesses 12 with the protruding engaging blocks 23.

The names of the members composing the present invention are only for illustrating a preferred embodiment of the present invention, and not for giving any limitation to the scope of the present invention. It will be apparent to those skilled in this art that various equivalent modifications or changes made to the present invention without departing from the spirit of this invention shall fall within the scope of the appended claims.

What is claimed is:

1. An improved structure of connector at least comprising an insertion-connecting socket unit, a lower lid, a metallic housing for an insertion slot, a group of pins and a plurality of metallic covers; wherein said insertion-connecting socket unit is provided on said lower lid, said metallic housing for said insertion slot is provided outside of said insertion-connecting socket unit, said group of pins are respectively inserted into said insertion-connecting socket unit and said lower lid, said metallic covers are provided at two lateral sides on said lower lid, and wherein said structure has the following features:

said insertion-connecting socket unit being provided on two lateral sides thereof with two protruding engaging posts which have therebeneath two recesses;

said lower lid having at two lateral sides thereof two columns which are provided on inner sides thereof with two engaging grooves in corresponding in position to said protruding engaging posts, and two protruding engaging blocks in corresponding in position to said recesses;

thereby, said insertion-connecting socket unit and said lower lid get their effects of positioning and fixing by fixed engagement of said protruding engaging posts with said engaging grooves as well as said recesses with said protruding engaging blocks.

2. The improved structure of connector as stated in claim 1, wherein said insertion-connecting socket unit and said metallic housing for said insertion slot are provide on mutual corresponding positions thereon respectively with a plurality of insertion dents and engaging strip portions, in order that said metallic housing is inserted and positioned on said insertion-connecting socket unit.

3. The improved structure of connector as stated in claim 2, wherein said lower lid and said metallic housing for said insertion slot are provided with round holes in order that locking elements are used to lock said lower lid and said metallic housing on an electric circuit board.

4. The improved structure of connector as stated in claim 1, wherein said two columns at said two lateral sides of said lower lid and said metallic covers are provided on the upper and lower ends thereof with insertion dents and engaging strip portions respectively, in order that said metallic covers are fixed on said two columns at said two lateral sides of said lower lid by insertion connecting of said insertion dents with said engaging strip portions.

5. The improved structure of connector as stated in claim 1, wherein a group of pin jacks are provided on said insertion-connecting socket unit, said lower lid has thereon a group of pin holes, said group of pins are inserted into said group of pin jacks and said group of pin holes to thereby fixed on said insertion-connecting socket unit and said lower lid.

* * * * *